US007212760B2

(12) United States Patent
Yokono

(10) Patent No.: US 7,212,760 B2
(45) Date of Patent: May 1, 2007

(54) IMAGE FORMING APPARATUS PERFORMING IMPROVED FIXING TEMPERATURE CONTROL

(75) Inventor: Masaharu Yokono, Fujisawa (JP)

(73) Assignee: Ricoh Company, Ltd., Tokyo (JP)

( * ) Notice: Subject to any disclaimer, the term of this patent is extended or adjusted under 35 U.S.C. 154(b) by 134 days.

(21) Appl. No.: 11/082,893

(22) Filed: Mar. 18, 2005

(65) Prior Publication Data

US 2005/0207775 A1 Sep. 22, 2005

(30) Foreign Application Priority Data

Mar. 19, 2004 (JP) ..... 2004-080291

(51) Int. Cl.
*G03G 15/20* (2006.01)

(52) U.S. Cl. ..... 399/69; 219/216; 399/33; 430/124

(58) Field of Classification Search ..... 399/69, 399/70, 67, 320, 328, 33; 219/216; 347/156; 430/124

See application file for complete search history.

(56) References Cited

U.S. PATENT DOCUMENTS

2003/0091359 A1* 5/2003 Cho et al. ..... 399/69
2005/0117923 A1* 6/2005 Sasamoto et al. ..... 399/67 X
2005/0123314 A1* 6/2005 Satoh ..... 399/69

FOREIGN PATENT DOCUMENTS

JP 2004-226498 A 8/2004
JP 2004-233745 A 8/2004

* cited by examiner

*Primary Examiner*—Sophia S. Chen
(74) *Attorney, Agent, or Firm*—Harness, Dickey & Pierce, P.L.C.

(57) ABSTRACT

An electrophotographic image forming apparatus includes a device to set a temperature correspondence electrifying duty ratio relative to a fixing heater of a fixing device according to a detected temperature. A device is included to set a power corresponding electrifying duty ratio relative to the fixing heater, according to a detected voltage; along with a device to compare the temperature correspondence electrifying duty ratio and the power correspondence electrifying duty ratio. When the temperature correspondence electrifying duty ratio is equal to or larger than the power correspondence electrifying duty ratio, it is restricted to obtain a restricted electrifying duty ratio. Electrifying control is then performed using the restricted ratio. When electrifying the fixing heater immediately after the power has been turned on, a power correspondence electrifying duty ratio is set according to a first voltage. Electrifying control is then performed using the set power correspondence electrifying duty ratio.

19 Claims, 6 Drawing Sheets

IMAGE FORMING APPARATUS PERFORMING IMPROVED FIXING TEMPERATURE CONTROL

PRIORITY STATEMENT

The present application claims priority and contains subject matter related to Japanese Patent Application No. 2004-080291 filed in the Japanese Patent Office on Mar. 19, 2004, the entire contents of which are hereby incorporated herein by reference.

BACKGROUND

In an image forming apparatus of electrophotography, including a copying machine, a printer, etc., an electrostatic latent image according to image data of an original document is formed on a photoconductor rotating in a sub-scanning direction. This is achieved by exposing the surface of the photoconductor uniformly charged in advance with an exposure device (an optical writing device), and by causing toner to be adhered to the latent image on the photoconductor with a developing device, a toner image is formed on the photoconductor.

The toner image is then transferred onto a record sheet (a transfer sheet) with a transfer device. Thereafter, the toner image is fixed to the record sheet by heating and pressing the toner image on the record sheet with a fixing device, including for example a fixing roller including a built-in fixing heater.

In such an image forming apparatus, generally, the surface temperature of the fixing device (e.g., the fixing temperature of the fixing device) is controlled to accord with a target temperature. The surface temperature of the fixing device is detected with a sensor. According to a detected temperature, the electrifying duty ratio (the ratio of an electrifying or non-electrifying time per a unit time) relative to the fixing heater of the fixing device is controlled so that the fixing temperature of the fixing device accords with the target temperature. As a method of controlling the electrifying duty ratio relative to a fixing heater of a fixing device, it is known to control the electrifying duty ratio based on a temperature difference between a detected fixing temperature and a target temperature or based on both of the temperature difference and past control amounts.

In a known image forming apparatus performing control of the fixing temperature of a fixing device, a fixing device is provided with a fixing heater having a relatively large heating value to avoid forming an inferior image when the voltage of the commercial power source has been lowered to a lower limit or to complete warming up of the fixing device within a period of time when the power has been turned on or the apparatus has returned to the standby state from a power saving mode.

In such an image forming apparatus in which a fixing heater having a relatively large heating value is provided in a fixing device and in which the fixing temperature of the fixing device is controlled by way of controlling the electrifying duty ratio relative to the fixing heater, however, controlling the electrifying duty ratio is performed under similar conditions regardless of variation in the heating value among fixing heaters or variation in the voltage of commercial power sources at premises of users. Therefore, for example, if an AC input voltage of a commercial power source at a premise of a user exceeds a rated voltage, the fixing heater unnecessarily consumes a large amount of power.

To avoid such consumption of an unnecessarily large amount of power, in image forming apparatuses described in JP laid-opened publications No. 2000-29348 and No. 11-161098, a voltage of a commercial power source is detected. The electrifying duty ratio relative to a fixing heater of a fixing device is then restricted with a detected voltage of the commercial power source so that the maximum power consumption of the fixing heater is equal to or smaller than a value.

In such an image forming apparatus in which a voltage of a commercial power source is detected for controlling the fixing temperature of a fixing device, however, immediately after the power of the apparatus has been turned on or immediately after the apparatus has returned to the standby state from a power saving mode, the fixing device including a built-in fixing heater in a low temperature state is rapidly heated to be in a high temperature state that a satisfactory image can be formed and the electrical resistance value of the fixing heater rapidly changes with rising of temperature. Thus, an input voltage of the commercial power source cannot be correctly detected. Accordingly, the above-described controlling of the electrifying duty ratio relative to the fixing heater such that the maximum power consumption of the fixing heater to be equal to or below a value cannot be performed and countermeasures against an abnormal voltage cannot be taken.

Therefore, it is necessary to start controlling of the electrifying duty ratio relative to the fixing heater after the electrical resistance value of the fixing heater has been stabilized. This, however, increases the amount of time to heat the fixing device to be in a state that a satisfactory image can be formed immediately after the power has been turned on or immediately after the apparatus has returned to the standby state from a power saving mode.

SUMMARY

Preferred embodiments of the present invention provide a novel image forming apparatus of electrophotography. In at least one embodiment, even when an input voltage of the commercial power source cannot be correctly detected, electrifying control relative to a fixing heater of a fixing device using a proper electrifying duty ratio may be performed. Thereby, the amount of time to heat the fixing device to be in the state that a satisfactory image can be formed immediately after the power of the apparatus has been turned on or immediately after the apparatus has returned to the standby state from a power saving mode, can be shortened while properly controlling the power consumption.

According to an embodiment of the present invention, an electrophotographic image forming apparatus includes a fixing device including a fixing heater and configured to fix a toner image on a record sheet to the record sheet, a temperature detect device configured to detect a surface temperature of the fixing device, and a power source voltage detect device configured to detect a voltage of a commercial power source supplying electricity to the fixing heater of the fixing device. The apparatus further includes a temperature correspondence electrifying duty ratio setting device configured to perform a process of detecting a surface temperature of the fixing device with the temperature detect device and setting, according to a detected surface temperature of the fixing device, a ratio of an electrifying or non-electrifying time per a unit time relative to the fixing heater as a temperature correspondence electrifying duty ratio; a power correspondence electrifying duty ratio setting device configured to perform a process of detecting a voltage of the commercial power source with the power source voltage detect device and setting, according to a detected voltage of the commercial power source, a ratio of an electrifying or non-electrifying time per a unit time relative to the fixing heater as a power correspondence electrifying duty ratio; an electrifying duty ratio restriction device configured to restrict the temperature correspondence electrifying duty ratio set by the temperature correspondence electrifying duty ratio setting device with the power correspondence electrifying duty ratio set by the power correspondence electrifying duty ratio setting device to obtain a restricted electrifying duty ratio; and a heater electrifying control device configured to compare the temperature correspondence electrifying duty ratio set by the temperature correspondence electrifying duty ratio setting device and the power correspondence electrifying duty ratio set by the power correspondence electrifying duty ratio setting device, to select either of the temperature correspondence electrifying duty ratio set by the temperature correspondence electrifying duty ratio setting device and the restricted electrifying duty ratio obtained by the electrifying duty ratio restriction device, and to perform electrifying control relative to the fixing heater using a selected electrifying duty ratio.

When electrifying the fixing heater immediately after the commercial power source has been turned on or immediately after the apparatus has returned to the standby state from a power saving mode, the power correspondence electrifying duty ratio setting device sets a power correspondence electrifying duty ratio according to a voltage. Further, the heater electrifying control device performs electrifying control relative to the fixing heater using the power correspondence electrifying duty ratio set by the power correspondence electrifying duty ratio setting device according to the voltage.

In the image forming apparatus of at least one embodiment, a value of the voltage may be set such that the power correspondence electrifying duty ratio set by the power correspondence electrifying duty ratio setting device according to the voltage is equal to or below a value. Further, the voltage may be an upper limit voltage of the apparatus.

In the image forming apparatus of at least one embodiment, the power correspondence electrifying duty ratio setting device may perform the process of detecting a voltage of the commercial power source with the power source voltage detect device and setting, according to a detected voltage of the commercial power source, a ratio of an electrifying or non-electrifying time per a unit time relative to the fixing heater as a power correspondence electrifying duty ratio while electrifying of the fixing heater immediately after the commercial power source has been turned on or immediately after the apparatus has returned to the standby state from the power saving mode is being performed. Further, the power correspondence electrifying duty ratio setting device may start the process a time after starting the electrifying of the fixing heater. Furthermore, the time may be a time necessary for the fixing heater to be in a state that a resistance value thereof is stabilized after the electrifying of the fixing heater has been started.

According to another embodiment of the present invention, a method of controlling electrifying of a fixing heater of a fixing device in an electrophotographic image forming apparatus is provided. The method includes; setting a ratio of an electrifying or non-electrifying time per a unit time relative to the fixing heater according to a voltage as a power correspondence electrifying duty ratio and performing electrifying control relative to the fixing heater using the set power corresponding electrifying duty ratio, when electrifying the fixing heater immediately after the commercial power source of the apparatus has been turned on or immediately after the apparatus has returned to the standby state from a power saving mode; detecting a voltage of the commercial power source, obtaining, according to a detected voltage of the commercial power source, a ratio of an electrifying or non-electrifying time per a unit time relative to the fixing heater as a power correspondence electrifying duty ratio, and storing the power correspondence electrifying duty ratio; detecting a surface temperature of the fixing device, and obtaining, according to a detected surface temperature of the fixing device, a ratio of an electrifying or non-electrifying time per a unit time relative to the fixing heater as a temperature correspondence electrifying duty ratio; and comparing the temperature correspondence electrifying duty ratio and the stored power correspondence electrifying duty ratio. The method further includes, when the temperature correspondence electrifying duty ratio is equal to or larger than the stored power correspondence electrifying duty ratio, restricting the temperature correspondence electrifying duty ratio with the stored power correspondence electrifying duty ratio to obtain a restricted electrifying duty ratio, and performing electrifying control relative to the fixing heater using the restricted electrifying duty ratio.

In the method of at least one embodiment, a value of the voltage may be set such that the power correspondence electrifying duty ratio set according to the voltage is equal to or below a value. Further, the voltage may be an upper limit voltage of the apparatus.

In the method of at least one embodiment, the voltage detecting and a power correspondence electrifying duty ratio storing step may be performed while electrifying of the fixing heater using the power correspondence electrifying duty ratio set according to the voltage is being performed. Further, the voltage detecting and a power correspondence electrifying duty ratio storing step may be started a time after starting the electrifying of the fixing heater using the power correspondence electrifying duty ratio set according to the voltage. Furthermore, the time may be a time necessary for the fixing heater to be in a state that a resistance value thereof is stabilized after the electrifying of the fixing heater using the power correspondence electrifying duty ratio set according to the voltage has been started.

BRIEF DESCRIPTION OF THE DRAWINGS

A more complete appreciation of the present application and many of the attended advantages thereof will be readily obtained by reference to the following detailed description of example embodiments when considered in connection with the accompanying drawings, wherein.

DETAILED DESCRIPTION OF EXAMPLE EMBODIMENTS

Figure 1:
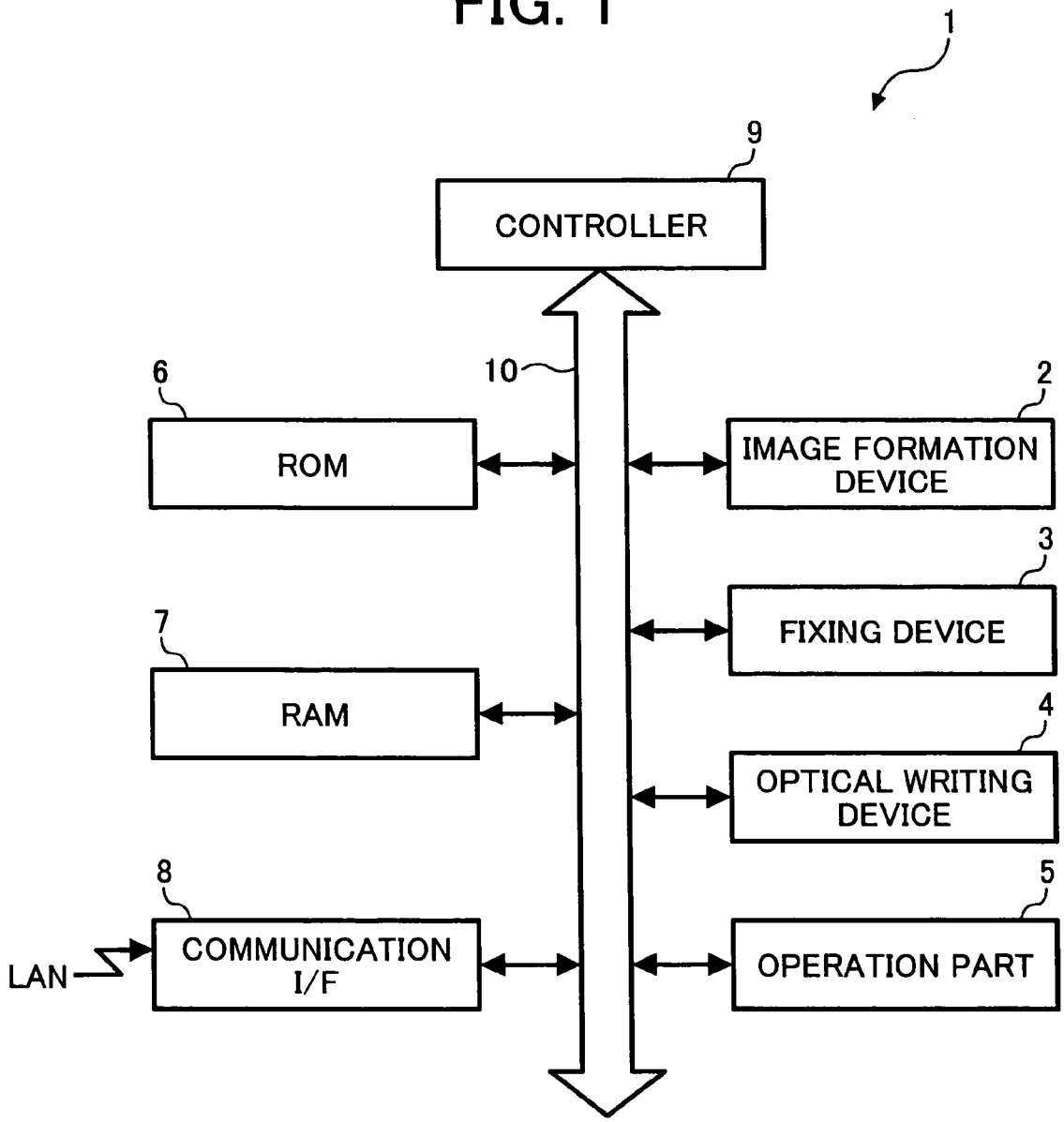
FIG. 1 is a diagram schematically illustrating a construction of a printer as an image forming apparatus according to an embodiment of the present invention.

Referring now to the drawings, wherein like reference numerals designate identical or corresponding parts throughout the several views, preferred embodiments of the present invention are described.

FIG. 1 is a block diagram illustrating a construction of a printer as an image forming apparatus of electrophotography according to an embodiment of the present invention.

A printer 1 includes an image formation device 2, a fixing device 3, an optical writing device 4, an operation part 5, a ROM 6, a RAM 7, a communication I/F 8, and a controller 9.

The image formation device 2 includes, though not illustrated in FIG. 1, a photoconductor in a belt-like or drum-like shape, a charging device, a development device, and a transfer device. The surface of the photoconductor is charged with the charging device, an electrostatic latent image is formed on the surface of the photoconductor with the optical writing device, the latent image on the photoconductor is developed into a toner image by causing toner to be adhered to the latent image with the development device, and the toner image on the photoconductor is transferred onto a record sheet with the transfer device.

The fixing device 3 includes a fixing heater (not shown) for heating the surface of the fixing device 3, and fixes the toner image on the record sheet to the record sheet by pressing and heating the toner image.

The optical writing device includes a laser diode, a polygon mirror and a scanning lens, which are not shown in FIG. 1. The laser diode is modulated according to image data from the controller 9 and emits a corresponding laser beam, the laser beam is cyclically deflected by the polygon mirror, the deflected laser beam is condensed with the scanning lens, and the laser beam scans the surface of the photoconductor, rotating in the sub-scanning direction and uniformly charged by the charging device, repetitively in the main scanning direction. Thereby, the surface of the photoconductor is exposed and the latent image is formed on the photoconductor.

The operation part 5 is configured to set the condition of the printer 1 according to manipulation thereof by the user or operator.

The ROM 6 records and stores programs and parameters used in controlling the printer 1.

The RAM 7 records and stores the content of initial setting of the printer 1 and is backed up by a battery (not shown).

The communication I/F 8 is connected with a host computer (not shown) for example a PC, etc. via a network which may be a LAN for example, and controls communication with the host computer. For example, the communication I/F 8 receives print data from the host computer.

The controller 9 controls the entire parts of the printer 1 and includes a CPU 22 (FIG. 2) as a central processor. The controller 9 controls respective parts of the printer 1 via a bus 10. The CPU 22 reads out programs stored in the ROM 6 and executes various processes.

Figure 2:
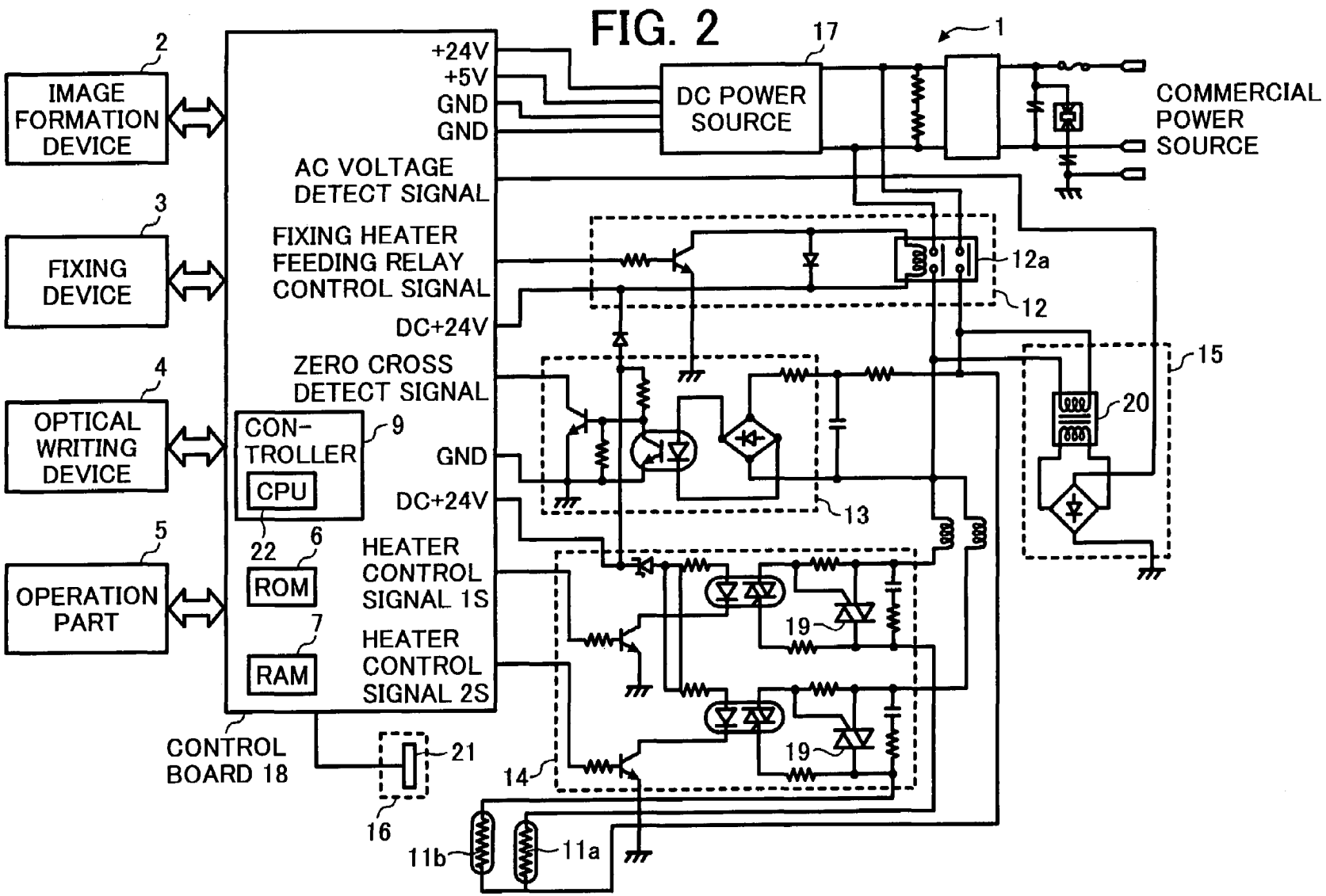
FIG. 2 is a block diagram illustrating parts of the printer relating to electrifying control relative to a fixing heater of a fixing device of the printer.

FIG. 2 is a block diagram illustrating parts of the printer 1 relating to electrifying control relative to the fixing heater of the fixing device 3.

As illustrated in FIG. 2, the printer 1 includes a fixing heater relay control part 12, a zero cross detect part 13, a fixing heater electrifying control part 14, an AC voltage detect part 15, a temperature detect part 16, a DC power source 17, and a control board 18. In this embodiment, the fixing device 3 includes two fixing heaters, a fixing heater 11*a* and a fixing heater 11*b*. Accordingly, two sets of parts relating to electrifying control relative the fixing device 3 are provided.

The fixing heater relay control part 12 controls turning on and off of electrifying the fixing heaters 11*a* and 11*b* with the commercial power source supplying AC power, based on a fixing heater feeding relay control signal which is inputted from the control board 18. When the power of the printer 1 has been turned on or when the printer 1 has returned to the standby state from the power saving mode, electrifying the fixing heaters 11*a* and 11*b* is turned on by turning on a fixing relay 12*a*. Further, when an error has occurred in the fixing heaters 11*a* and 11*b* and/or in their peripheral parts, electrifying the fixing heaters 11*a* and 11*b* is turned off by turning off the fixing relay 12*a*.

The zero cross detect part 13 detects zero crossing of the AC voltage when electrifying of the fixing heaters 11*a* and 11*b* has been turned on, and outputs a zero cross signal. The zero cross signal may be used for the basis of switching timing of turning on and off of electrifying the fixing heaters 11*a* and 11*b*.

The fixing heater electrifying control part 14 controls electrifying the fixing heaters 11*a* and 11*b* using triacs 19 according to heater control signals 1*s* and 2*s* inputted from the control board 18. The heater control signals 1*s* and 2*s* are generated at the control board 18 and designate the electrifying duty ratios (the electrifying or non-electrifying times per a unit time) relative to the fixing heaters 11*a* and 11*b*. Further, the power supply amounts to the fixing heaters 11*a* and 11*b* are controlled in proportion to the electrifying duty ratios.

The AC voltage detect part 15 may function as a power source voltage detect device of an embodiment of the present invention. After stepping down an AC voltage inputted from the commercial power source with a transformer 20, it then converts the AC voltage to a DC voltage detectable with the control board 18, and outputs the converted DC voltage. The DC voltage is outputted as an AC voltage detect signal, and changes in one-to-one proportion relative to an actual value of the inputted AC voltage (the voltage of the commercial power source).

The temperature detect part 16 may serve as a temperature detect device of an embodiment of the present invention, and detects a surface temperature (e.g. the fixing temperature) of the fixing device 3 including the fixing heaters 11*a* and 11*b* with a temperature detect sensor 21, for example a thermistor, etc., and inputs a detect signal to the control board 18.

The DC power source 17 converts the AC voltage of the commercial power source to a rated DC voltage and supplies the DC voltage to respective parts of the printer 1 via the control board 18.

The control board 18 includes the ROM 6, the RAM 7 and the controller 9 including the CPU 22, and may function as a controller controlling the entire parts of the printer 1. The control board 18 outputs and inputs various detect signals and control signals to and from the fixing heater electrifying control part 14, the AC voltage detect part 15 and the temperature detect part 16, and thereby may function as a temperature correspondence electrifying duty ratio setting device, a power correspondence electrifying duty ratio setting device, an electrifying duty ratio restriction device, and a heater electrifying control device of an embodiment of the present invention.

Next, the description is made with respect to fixing temperature control (electrifying control relative to the fixing heaters 11*a* and 11*b* based on the fixing temperature) in the printer 1 configured as described above.

Generally, in an image forming apparatus, fixing temperature control is performed repetitively at the cycle of a unit time. The fixing temperature may be detected at the beginning of each unit time, and based on the detected temperature, the electrifying or non-electrifying time per the unit time relative to the fixing heaters 11*a* and 11*b* (that is, the temperature correspondence electrifying duty ratio) may be obtained.

The temperature correspondence electrifying duty ratio can be obtained by calculating a difference temperature "t" between a fixing temperature "ts" detected with the temperature detect part 16 and a target temperature "tr" stored in the ROM 6 (e.g., tr−ts), and by selecting an electrifying duty ratio corresponding to the difference temperature t from a correspondence table as illustrated in Table 1, which is stored in the ROM 6.

The temperature correspondence electrifying duty ratio can be obtained, for example, by a PID control, etc. In the PID control, a control value may be determined by combining, in response to an output value from a controlled object, a proportional control (P control), an integral control (I control) and a differential control (D control). Generally, the electrifying duty ratio, for example the temperature correspondence electrifying duty ratio, is expressed by the ratio of the electrifying time in a unit time as indicated in Table 1.

TABLE 1

| | $t < -3$ | $-3 \leqq t < 0$ | $t$ | $0 < t \leqq 3$ | $3 < t$ |
|---|---|---|---|---|---|
| Electrifying time (%) | 100% | 50% | 25% | 10% | 0% |

The printer 1 may be configured such that the power consumption does not exceed a relatively high or even maximum power consumption on the assumption that the printer 1 is used under various conditions, for example, under the condition that the voltage of the commercial power source is variable due to unstable power supply, etc. Here, the power consumption of the printer 1 may be the total of the power consumption of the fixing heaters 11*a* and 11*b* when the fixing heaters 11*a* and 11*b* are electrified at the duty ratio of 100% per a unit time under the condition that the voltage of the commercial power source has reached a relatively low or even minimum voltage and the power consumption of the DC power source 17 supplying DC power to respective parts of the printer 1 during the printing operation.

Now, a method of an embodiment of controlling the power consumption of the printer 1 in response to conditions of the commercial power source and the printer 1 and operations of the printer 1 is described.

Generally, a printer using a fixing device with a built-in fixing heater is in either of three states, a standby state, a warming up state, and a printing state. The standby state may be considered the state where the fixing heaters 11*a* and 11*b* are not electrified at all, or the surface temperature of the fixing device 3 is kept below a fixable temperature even when the fixing heaters 11*a* and 11*b* are electrified. The warming up state may be considered the state where the fixing heaters 11*a* and 11*b* in the standby state are electrified until the surface temperature of the fixing device 3 rises to the fixable temperature, e.g. the state where a rising operation is being performed. The printing state may be considered the state where the surface temperature of the fixing device 3 is at the fixable temperature and an actual printing operation is being performed.

In the standby state, because the image formation device 2, the fixing device 3, and the optical writing device 4 are not operated, the DC load is relatively low or even minimum, and the power consumption is relatively small. In the warming up state, the fixing device 3 is operated, and the image formation device 2 and the optical writing device 4 are partially operated. Thus, the power consumption is increased when compared with the standby state. In the printing state, all of the image formation device 2, the fixing device 3 and the optical writing device 4 are operated. Thus, the power consumption is relatively increased the most.

Here, the power consumptions of the DC power source 17 in the standby state, the warming up state, and the printing state are expressed as Wx, Wy and Wz, respectively and are stored in the ROM 6 as parameters. Similarly, the relatively high or even maximum power consumption of the printer 1 per a unit time is expressed as Wo and is stored in the ROM 6 a parameter.

When the relatively high or even maximum power consumption of the fixing heaters 11*a* and 11*b* per a unit time is Wh, the power consumption of the printer 1 is Wh+Wx in the standby state, Wh+Wy in the warming up state, and Wh+Wz in the printing state. Here, the power consumptions of the fixing heaters 11*a* and 11*b* per a unit time Wh, that can be used in the standby state, the warming up state, and the printing state can be controlled such that relationships of $Wh+Wx \leqq Wo$, $Wh+Wy \leqq Wo$ and $Wh+Wz \leqq Wo$ are satisfied, respectively. Accordingly, when Wc is Wx, Wy or Wz, the following relationship holds; $Wh \leqq Wo-Wc$ (formula 1).

Thus, by making the power consumption of the fixing heaters 11*a* and 11*b* variable according to the states of the printer 1, the power consumption of the printer 1 can be controlled.

Next, an embodiment of a method of controlling the relatively high or even maximum power consumption of the fixing heaters 11*a* and 11*b* per a unit time to be equal to or smaller than a value regardless of a variation in the voltage of the commercial power source is described.

When the fixing heaters 11*a* and 11*b* are configured such that when a rated input voltage Vr is inputted, a rated power consumption is Wr, the power consumption W of the fixing heaters 11*a* and 11*b* when an input voltage V is inputted can be obtained by the following formula 2; $W=Wr\times((V-Vs)/$ $Vr)^{(1/0.65)}$, wherein Vs is a decreased voltage caused by a power cord, etc., connected with a connector of the commercial power source.

Accordingly, the power consumption of the fixing heaters 11*a* and 11*b* per a unit time differs depending upon variation in the voltage of the commercial power source.

The above-described formula 1 is based on that the electrifying duty ratio per a unit time is 100%.

When the electrifying duty ratio is variable, the following relationship (formula 3) holds; $Wt=Wr\times((V-Vs)/Vr)^{(1/0.65)}\times Tb/Ta$, wherein Ta is a unit time for controlling electrifying of the fixing heaters 11*a* and 11*b* (which may be stored in the ROM 6, for example), Tb is a time of electrifying the fixing heaters 11*a* and 11*b* in the unit time Ta ($0<Tb\leqq Ta$), and Wt is the power consumption of the fixing heaters 11*a* and 11*b* per the unit time Ta.

The rated power consumption Wr of the fixing heaters 11*a* and 11*b* relative to the rated input voltage Vr may be specified and may be stored as a parameter in the ROM 6 in advance.

Here, in order to make the power consumption of the printer 1 to be equal to or below a value, the following relationship (formula 4) holds; $Wt\leqq Wh$.

Further, the electrifying time Tb may be determined such that the following relationship (formula 5) is satisfied, and the determined electrifying time Tb may be stored in the RAM 7;

$$Wr\times((V-Vs)/Vr)^{(1/0.65)}\times Tb/Ta\leqq Wh$$

$$Tb\leqq Wh\times Ta/(Wr\times((V-Vs)/Vr)^{(1/0.65)})$$

Figure 3:
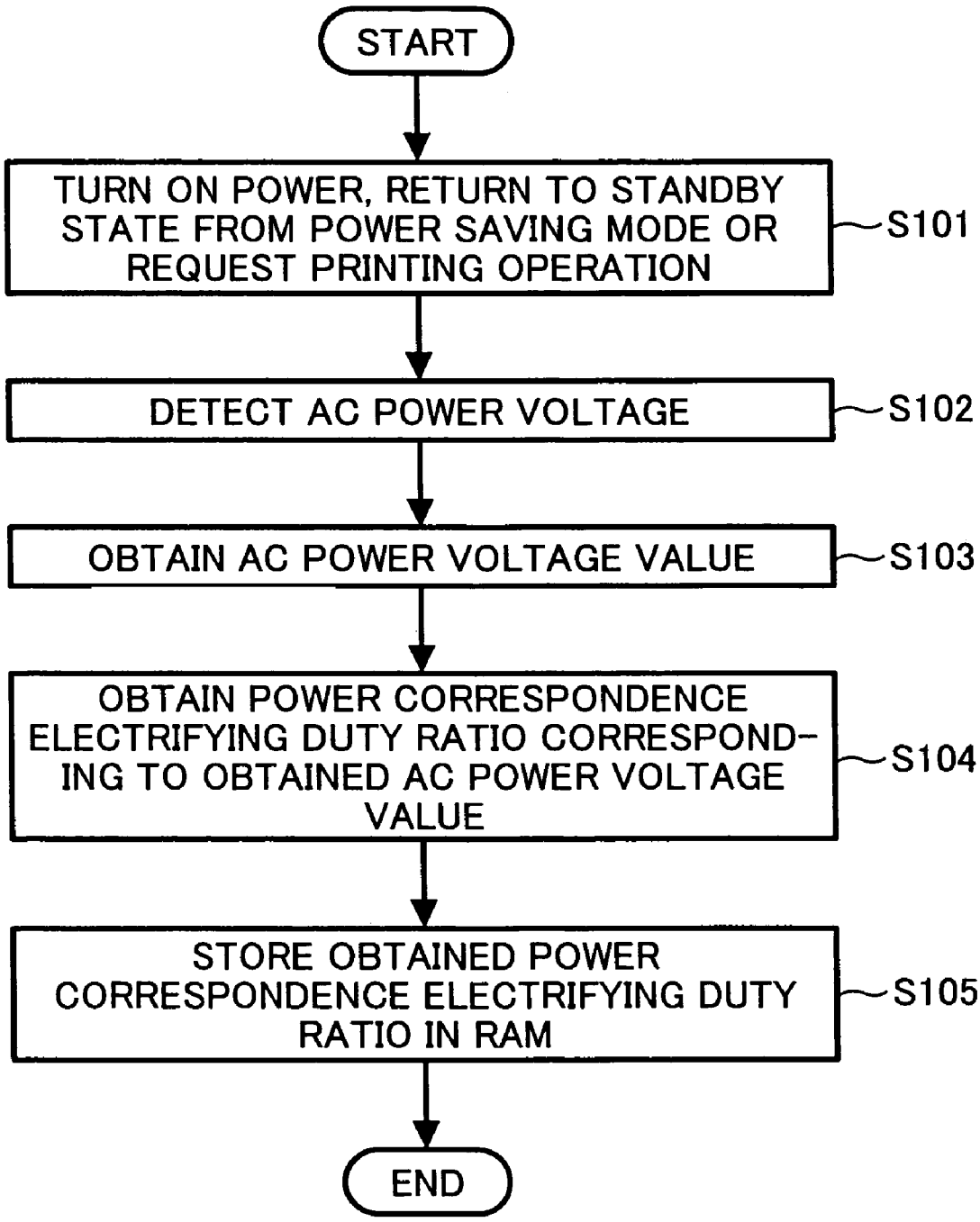
FIG. 3 is a flowchart illustrating an example process of obtaining a power correspondence electrifying duty ratio relative to the fixing heater corresponding to each state of the printer.

The electrifying duty ratio per a unit time (the ratio of the electrifying time Tb per the unit time Ta) relative to the fixing heaters 11*a* and 11*b* is thus obtained as a power correspondence electrifying duty ratio corresponding to the relatively maximum power that can be supplied to the fixing heaters 11*a* and 11*b* without exceeding the relatively high or even maximum power consumption specified in the printer 1. By electrifying the fixing heaters 11*a* and 11*b* using an electrifying time equal to or below the power correspondence electrifying duty ratio Tb, the power consumption of the fixing heaters 11*a* and 11*b* per the unit time can be properly controlled FIG. 3 is a flowchart illustrating an example process of obtaining a power correspondence electrifying duty ratio corresponding to each state of the printer 1. The CPU 22 executes the process according to a program stored in the ROM 6.

When the power of the commercial power source has been turned on, the apparatus has returned to the standby state from the power saving mode or a printing operation has been requested and a trigger which is a condition for starting detection of an AC voltage has been detected (step S101), detection of the AC voltage is started, and a DC voltage signal outputted from the AC voltage detect part 15 is sampled at an arbitrary number of times (step S102). The average value or the center value of the DC voltage signal is obtained as a detect value and an AC voltage (an AC power voltage value) corresponding to the detect value of the DC voltage in the proportion of one to one is obtained (step S103).

The power correspondence electrifying duty ratio Tbx, which is an upper limit of the electrifying time Tb, corresponding to the AC power voltage value at that time (the standby state, the warming up state, or the printing state), is obtained based on the above-described formula 5 (step S104). The obtained power correspondence electrifying duty ratio Tbx is stored in the RAM 7 to be kept until the next AC voltage detection (step S105), and the process ends. According to the process described above, power correspondence electrifying duty ratios Tbx relative to the fixing heaters 11*a* and 11*b* corresponding to respective states of the printer 1 are obtained.

In the printer 1, the controller 9 arranged on the control board 18 may execute the above-described process, and thereby both of a temperature correspondence electrifying duty ratio Tby and a power correspondence electrifying duty ratio Tbx may be obtained. The controller 9 compares the temperature correspondence electrifying duty ratio Tby and the power correspondence electrifying ratio Tbx, and causes the fixing heater electrifying controller 14 to control electrifying of the fixing heaters 11*a* and 11*b* using the obtained temperature correspondence electrifying duty ratio Tby as it is, or restricts the obtained temperature correspondence electrifying duty ratio Tby with the obtained power correspondence electrifying duty ratio Tbx and causes the fixing heater electrifying controller 14 to control electrifying of the fixing heaters 11*a* and 11*b* using a restricted electrifying duty ratio obtained by restricting the obtained temperature correspondence electrifying duty ratio Tby with the obtained power correspondence electrifying duty ratio Tbx. Thereby, appropriate electrifying control corresponding to respective states of the printer 1 can be performed relative to the fixing heaters 11*a* and 11*b*.

Figure 4:
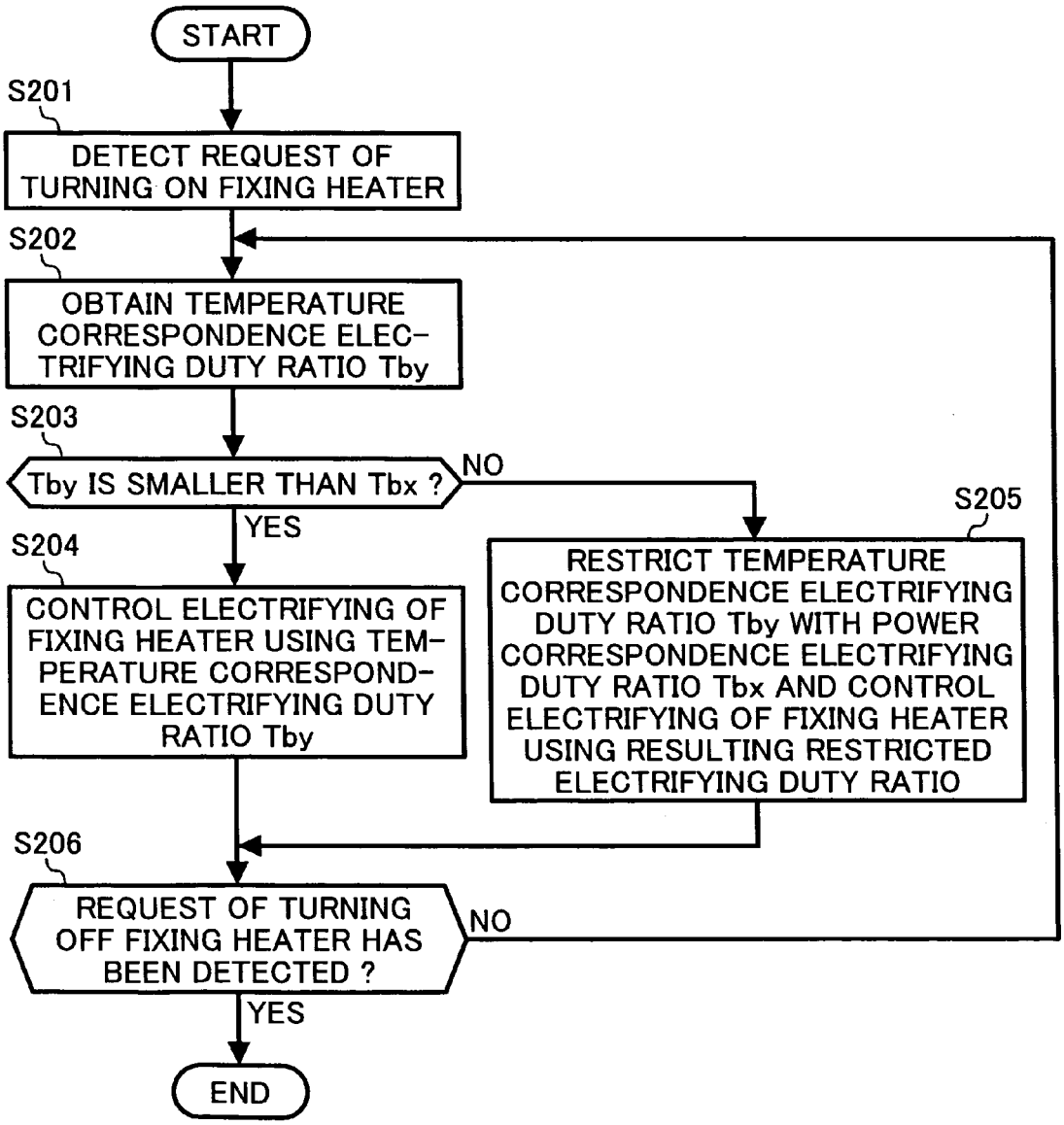
FIG. 4 is a flowchart illustrating an example electrifying control process relative to the fixing heater according to an embodiment of the present invention.

FIG. 4 is a flowchart illustrating an example electrifying control process performed by the CPU 22 relative to the fixing heaters 11*a* and 11*b* according to an embodiment of the present invention.

Figure 5:
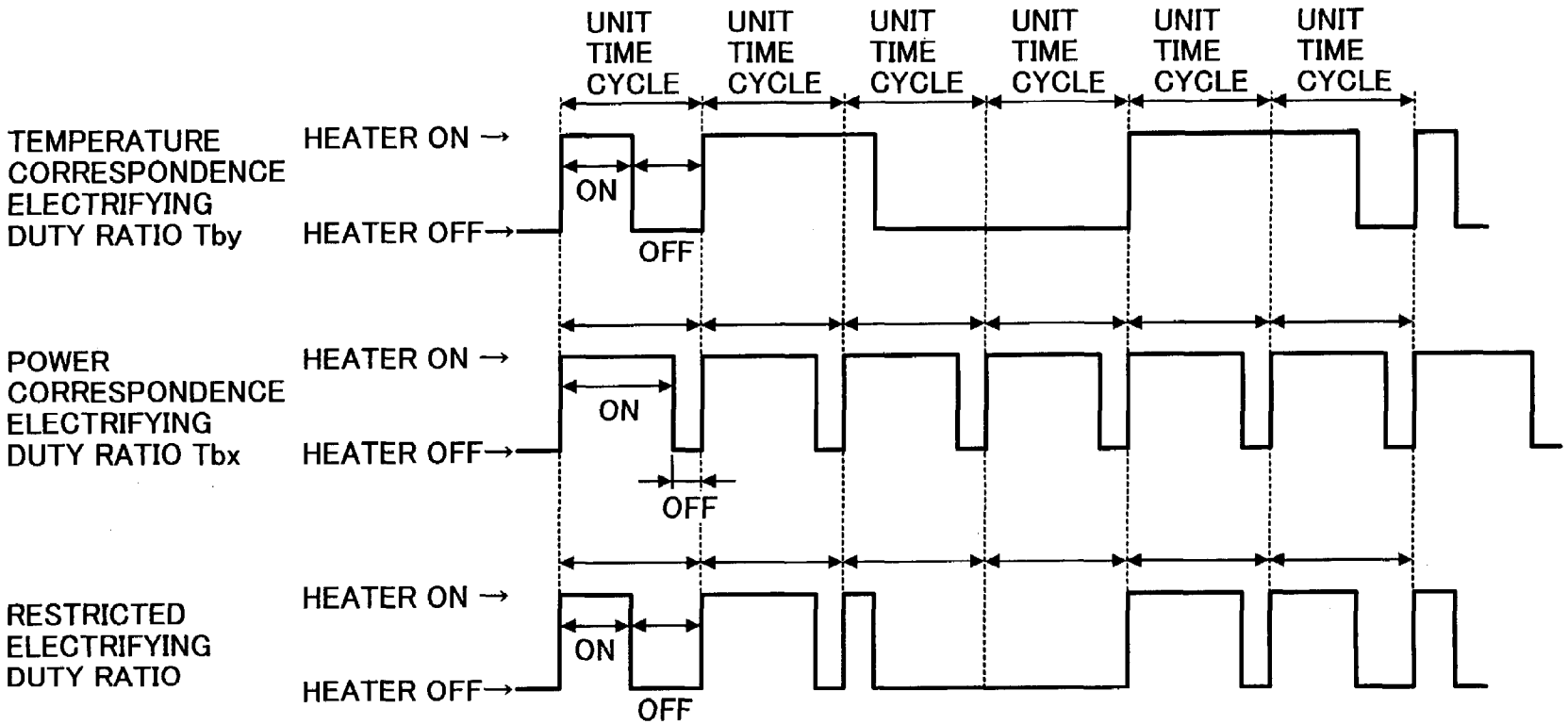
FIG. 5 is a diagram illustrating example heater control signals corresponding to a temperature correspondence electrifying duty ratio Tby, a power correspondence electrifying duty ratio Tbx, and a restricted electrifying duty ratio obtained by restricting the temperature correspondence electrifying duty ratio Tby with the power correspondence electrifying duty ratio Tbx, which are outputted from a control board of the printer.

FIG. 5 is a diagram illustrating example heater control signals corresponding to a temperature correspondence electrifying duty ratio Tby, a power correspondence electrifying duty ratio Tbx, and a restricted electrifying duty ratio obtained by restricting the temperature correspondence electrifying duty ratio Tby with the power correspondence electrifying duty ratio Tbx, which are outputted from the control board 18.

In FIG. 4, when a request of turning on electrifying of the fixing heaters 11*a* and 11*b* has been detected in step S201, the CPU 22 obtains (for example, selects, calculates, etc.) a temperature correspondence electrifying duty ratio Tby with the above-described fixing temperature control (step S202).

The temperature correspondence electrifying duty ratio Tby is obtained at the beginning of each unit time and changes in response to changes of the fixing temperature in real time. Thus, the waveform of a corresponding heater control signal irregularly changes as illustrated in the upper part of FIG. 5. On the other hand, a power correspondence electrifying duty ratio Tbx may be obtained at the time of requesting a switch in the state of the printer 1, and as long as the same state continues, the same value stored in the RAM 7 may be repeatedly referenced at the cycle of the unit time. Thus, the waveform of a corresponding heater control signal is repetitive as illustrated in the middle part of FIG. 5.

Then, a comparison may be made between the temperature correspondence electrifying duty ratio Tby obtained in step S202 and the power correspondence electrifying duty ratio Tbx stored in the RAM 7 (step S203).

When the temperature correspondence electrifying duty ratio Tby is smaller than the power correspondence electrifying duty ratio Tbx (e.g. $Tby<Tbx$), the temperature correspondence electrifying duty ratio Tby obtained in step S202 may be used in controlling electrifying of the fixing heaters 11*a* and 11*b* (step S204). That is, a heater control signal corresponding to the temperature correspondence electrifying duty ratio Tby illustrated in the upper part of FIG. 5 may be outputted to the fixing heater electrifying controller 14 to control electrifying of the fixing heaters 11*a* and 11*b*.

When the power correspondence electrifying duty ratio Tbx is equal to or smaller than the temperature correspondence electrifying duty ratio Tby (e.g. Tby<Tbx), the temperature correspondence electrifying duty ratio Tby may be restricted with the power correspondence electrifying duty ratio Tbx, and a resulting restricted electrifying duty ratio may be used in controlling electrifying of the fixing heaters 11*a* and 11*b*. That is, a heater control signal corresponding to the restricted electrifying duty ratio illustrated in the lower part of FIG. 5 may be outputted to the fixing heater electrifying controller 14 to control electrifying of the fixing heaters 11*a* and 11*b* (step S205).

Thereafter, it is checked if a request of turning off electrifying of the fixing heaters 11*a* and 11*b* has been detected (step S206). When the request has not been detected, the process returns to step S202. When the request has been detected, electrifying of the fixing heaters 11*a* and 11*b* is turned off, and the process ends.

Thus, a temperature correspondence electrifying duty ratio Tby and a power correspondence electrifying duty ratio Tbx may be compared for each unit time. When the temperature correspondence electrifying duty ratio Tby is smaller than the power correspondence electrifying duty ratio Tbx (e.g. Tby<Tbx), the temperature correspondence electrifying duty ratio Tby may be used in controlling electrifying of the fixing heaters 11*a* and 11*b*. Further, when the power correspondence electrifying duty ratio Tbx is equal to or smaller than the temperature correspondence electrifying duty ratio Tby (e.g. Tby≧Tbx), an electrifying duty ratio obtained by restricting the temperature correspondence electrifying duty ratio Tby with the power correspondence electrifying duty ratio Tbx may be used in controlling electrifying of the fixing heaters 11*a* and 11*b*.

That is, when the first control amount corresponding to a difference between a fixing temperature (a surface temperature of the fixing heaters 11*a* and 11*b*) and a target temperature is smaller than the second control amount corresponding to a supply power relative to the fixing heaters 11*a* and 11*b* that is restricted not to exceed the maximum power consumption of the printer 1, the first control amount may be used in controlling electrifying of the fixing heaters 11*a* and 11*b*. Further, when the first control amount is not smaller than the second control amount, a control amount obtained by restricting the first control amount with the second control amount may be used in controlling electrifying the fixing heaters 11*a* and 11*b*. Thereby, the power consumption of the printer 1 may be maintained to be equal to or below a value, without exceeding the prescribed maximum power consumption. Further, the fixing temperature can be made close to the target temperature as quickly as possible.

Next in another embodiment, a process performed by the CPU 22 at the time of warming up, for example when the power has been turned on and when the printer 1 has returned to the standby state from the power saving mode, is described.

Figure 6:
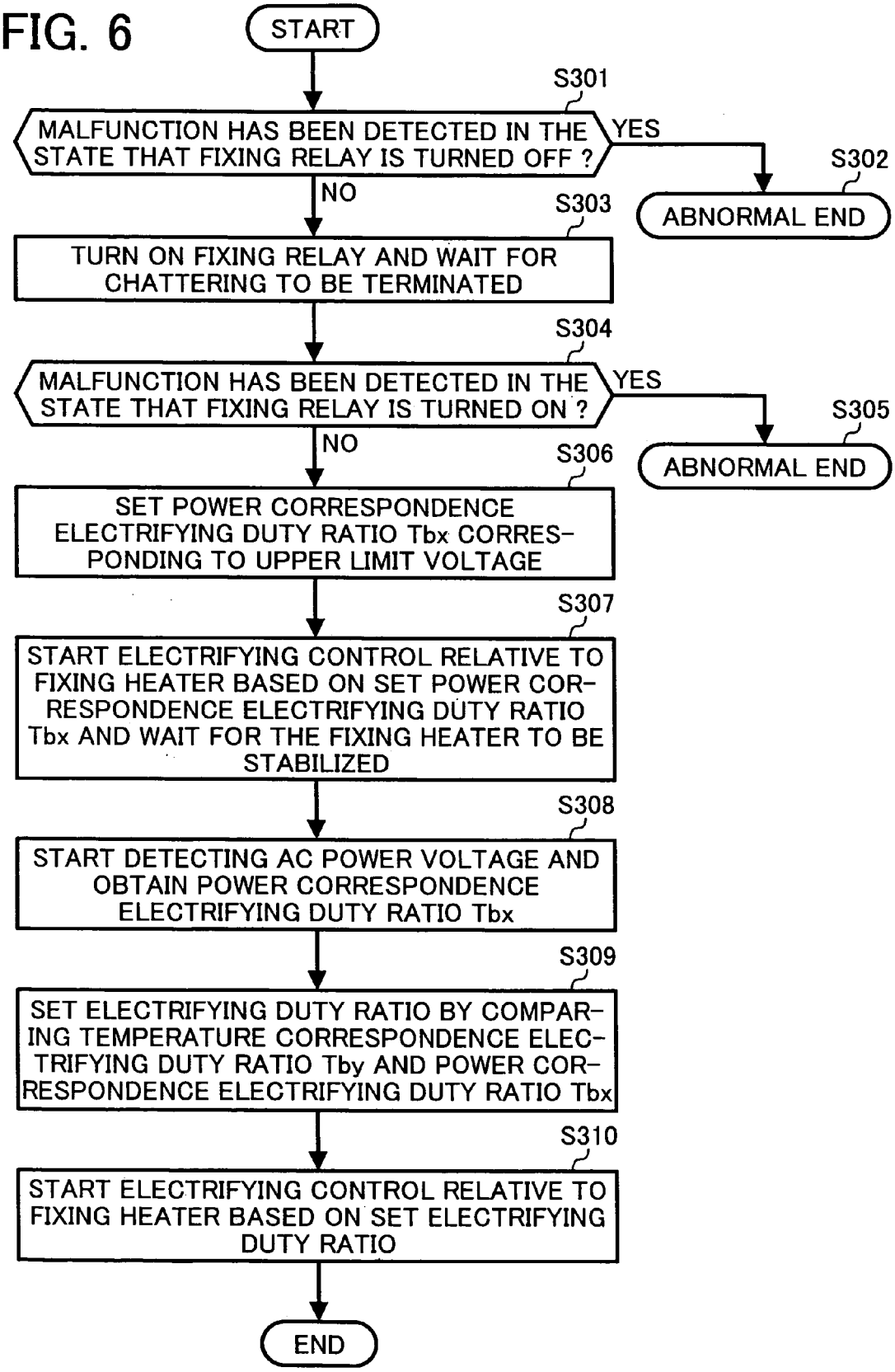
FIG. 6 is a flowchart illustrating an example process performed when the fixing heater is electrified immediately after the power has been turned on or immediately after the apparatus has returned to the standby state from the power saving mode in the printer.

FIG. 6 is a flowchart illustrating an example embodiment of a process performed when the fixing heaters 11*a* and 11*b* are electrified immediately after the power has been turned on or immediately after the apparatus has returned to the standby state from the power saving mode in the printer 1.

First, it is checked if a malfunction, for example welding in the fixing relay 12*a*, has been detected in the state that the fixing relay 12*a* of the fixing heater relay controller 12 is turned off (in the state that a contact point of the fixing relay 12*a* is opened) (step S301). When a malfunction has been detected, a process dealing with the malfunction is performed, a message is displayed on a display part of the operation part 5 or an audio message is outputted to inform the operator of the malfunction, and the process ends (step S302). When a malfunction has not been detected, the fixing relay 12*a* is turned on (the contact point of the fixing relay 12*a* is closed), and waits 100 ms for chattering to be terminated (step S303).

Then, it is checked if a malfunction, for example that a zero cross signal is not inputted, has been detected in the state that the fixing relay 12*a* of the fixing heater relay controller 12 is turned on (step S304). When a malfunction has been detected, a process dealing with the malfunction is performed and a message is displayed on the display part of the operation part 5 or an audio message is outputted to inform the operator of the malfunction, and the process ends (step S305).

When a malfunction has not been detected, the process proceeds to step S306. At this time, because the fixing heaters 11*a* and 11*b* are in a cooled down state and are rapidly heated to be in a high temperature state, the electrical resistance value of the fixing heaters 11*a* and 11*b* rapidly changes with temperature rise. Further, the input voltage of the commercial power source cannot be correctly detected even if detection with the AC voltage detect part 15 is performed. Thus, an appropriate power correspondence electrifying duty ratio Tbx cannot be obtained by referring to the input voltage of the commercial power source.

Accordingly, considering an inputted voltage of the commercial power source to be a voltage (an upper limit voltage prescribed in the product specification of the printer 1 for example), a power correspondence electrifying duty ratio Tbx corresponding to the voltage (the upper limit voltage) may be calculated and may be set (step S306). Then, electrifying control relative to the fixing heaters 11*a* and 11*b* may be started based on a heater control signal corresponding to the calculated power correspondence electrifying duty ratio Tbx (step S307). Thus, the power correspondence electrifying duty ratio Tbx may be obtained based on the upper limit voltage in the product specification of the printer 1, and thereby the non-electrifying time per the unit time relative to the fixing heaters 11*a* and 11*b* may be increased. Thus, the input voltage of the commercial power source can be surely put in the range of the product specification of the printer 1 and consumption of a power relatively larger than the prescribed maximum power consumption may be avoided.

The power correspondence electrifying duty ratio Tbx can be set to correspond to a voltage other than the upper limit voltage of the product specification. Further, after starting electrifying control relative to the fixing heaters 11*a* and 11*b*, the fixing temperature control based on the temperature correspondence electrifying duty ratio Tby may be performed until the fixing temperature (e.g. the surface temperature) of the fixing heaters 11*a* and 11*b* reaches a target temperature.

Here, when the fixing heaters 11*a* and 11*b* are in a cooled down state, the resistance value thereof is small. Thus, the input current (incoming current) becomes large at this time. Because of this effect, a decrease in the voltage at the fixing heaters 11*a* and 11*b* becomes large.

When electrifying of the fixing heaters 11*a* and 11*b* has been started and thereby the temperature of the fixing heaters 11*a* and 11*b* rises, the resistance value of the fixing heaters 11*a* and 11*b* also rises to be stable at a certain level. Then, the input current and the voltage decrease become stable at small values.

Therefore, the period of time it takes that the resistance value of the fixing heaters 11*a* and 11*b* reaches a stable level after electrifying of the fixing heaters 11*a* and 11*b* has been started is stored as a waiting time Tw in the ROM 6 in advance. Further, the process proceeds to step S308 after elapsing of the waiting time Tw after electrifying of the fixing heaters 11*a* and 11*b* has been started. In step S308, an output signal from the AC voltage detect part 15 is sampled a several number of times. Based on the sampling result, a corresponding power correspondence electrifying duty ratio Tbx is obtained as described above.

Then, the power correspondence electrifying duty ratio Tbx and the temperature correspondence electrifying duty ratio Tby are compared. When Tby<Tbx, the temperature correspondence electrifying duty ratio Tby is determined to be the electrifying duty ratio to be used in electrifying the fixing heaters 11*a* and 11*b*. Further, when Tby≧Tbx, an electrifying duty ratio obtained by restricting the temperature correspondence electrifying duty ratio Tby with the power correspondence electrifying duty ratio Tbx is determined to be the electrifying duty ratio to be used in electrifying the fixing heaters 11*a* and 11*b* (step S309), and electrifying control relative to the fixing heaters 11*a* and 11*b* is started based on a heater control signal corresponding to the electrifying duty ratio thus determined (step S310), and the process ends.

Thus, even when a change in the voltage of the commercial power source cannot be correctly detected, electrifying control relative to the fixing heaters 11*a* and 11*b* can be started while keeping the power consumption of the printer 1 equal to or below a value without exceeding the prescribed maximum power consumption. As a result, the amount of time to heat the fixing device 3 to be in the state that a satisfactory image can be formed can be shortened while properly controlling the power consumption. The waiting time Tw can be set otherwise than as described above.

An embodiment of the present invention has been described taking a printer of electrophotography as an example. Needless to say, that the embodiments of the present invention can be applied to various types of image forming apparatuses of electrophotography, for example a copying machine, a facsimile apparatus, etc.

Numerous additional modifications and variations of the present invention are possible in light of the above-teachings. It is therefore to be understood that within the scope of the claims, the present invention can be practiced otherwise than as specifically described herein.

The present invention being thus described, it will be obvious that the same may be varied in many ways. Such variations are not to be regarded as a departure from the spirit and scope of the present invention, and all such modifications are intended to be included within the scope of the present invention.

What is claimed is:

1. An image forming apparatus comprising:

a first device configured to set, according to a detected surface temperature of a fixing device for fixing a toner image to a record sheet, a ratio of an electrifying or non-electrifyring time per a unit time relative to a fixing heater of the fixing device, as a temperature correspondence electrifying duty ratio;

a second device configured to set, according to a detected voltage of a commercial power source, a ratio of an electrifying or non-electrifying time per a unit time relative to the fixing heater, as a power correspondence electrifying duty ratio;

a device configured to obtain a restricted electrifying duty ratio from the set temperature correspondence electrifying duty ratio and the set power correspondence electrifying duty ratio; and a heater control device configured to select one of the set temperature correspondence electrifying duty ratio and the obtained restricted electrifying duty ratio based upon the set temperature correspondence electrifying duty ratio and power correspondence electrifying duty ratio, and configured to perform electrifying control relative to the fixing heater using the selected electrifying duty ratio, wherein when electrifying the fixing heater immediately after the commercial power source has been turned on or immediately after the apparatus has returned to a standby state from a power saving mode, the power correspondence electrifying duty ratio is set according to a first voltage and the heater control device performs electrifying control relative to the fixing heater using the set power correspondence electrifying duty ratio.

2. The image forming apparatus according to claim 1, wherein a value of the first voltage is set such that the power correspondence electrifying duty ratio set by the power correspondence electrifying duty ratio setting device according to the first voltage is equal to or below a first value.

3. The image forming apparatus according to claim 2, wherein the first voltage is an upper limit voltage of the apparatus.

4. The image forming apparatus according to claim 1, wherein the power correspondence electrifying duty ratio setting device is configured to detect a voltage of the commercial power source via a power source voltage detect device and set, according to a detected voltage of the commercial power source, a ratio of an electrifying or non-electrifying time per a unit time relative to the fixing heater as a power correspondence electrifying duty ratio while electrifying of the fixing heater immediately after the commercial power source has been turned on or immediately after the apparatus has returned to the standby state from the power saving mode is being performed.

5. The image forming apparatus according to claim 4, wherein the power correspondence electrifying duty ratio setting device is configured to start a process of detecting a voltage of the commercial power source via the power source voltage detect device and set, according to a detected voltage of the commercial power source, a ratio of an electrifying or non-electrifying time per a unit time relative to the fixing heater as a power correspondence electrifying duty ratio, a time after starting the electrifying of the fixing heater immediately after the power having been turned on or immediately after the apparatus having returned to the standby state from the power saving mode.

6. The image forming apparatus according to claim 5, wherein the time is a time necessary for the fixing heater to be in a state that a resistance value thereof is stabilized after the electrifying of the fixing heater has been started.

7. The image forming apparatus according to claim 1, wherein the image forming apparatus is an electrophotographic image forming apparatus.

8. The image forming apparatus according to claim 1, wherein the image forming apparatus is a printer.

9. The image forming apparatus according to claim 1, wherein the image forming apparatus is a facsimile apparatus.

10. The image forming apparatus according to claim 1, wherein the image forming apparatus is a copying machine.

11. The image forming apparatus according to claim 1, further comprising:

the fixing device including the fixing heater and configured to fix a toner image to the sheet;

a temperature detect device configured to detect a surface temperature of the fixing device; and a power source voltage detect device configured to detect a voltage of a commercial power source supplying electricity to the fixing heater of the fixing device.

12. An electrophotographic image forming apparatus comprising:

means for setting, according to a detected a surface temperature of a fixing device for fixing a toner image to a sheet, a ratio of an electrifying or non-electrifying time per a unit time relative to a fixing heater of the fixing device as a temperature correspondence electrifying duty ratio;

means for setting, according to a detected voltage of a commercial power source, a ratio of an electrifying or non-electrifying time per a unit time relative to the fixing heater, as a power correspondence electrifying duty ratio;

means for obtaining a restricted electrifying duty ratio from the set temperature correspondence electrifying duty ratio and the set power correspondence electrifying duty ratio; and means for selecting one of the set temperature correspondence electrifying duty ratio and the obtained restricted electrifying duty ratio based upon the power correspondence electrifying duty ratio and the set temperature correspondence electrifying duty ratio, and for performing electrifying control relative to the fixing heater using a selected electrifying duty ratio, wherein when electrifying the fixing heater immediately after the commercial power source has been turned on or immediately after the apparatus has returned to a standby state from a power saving mode, the power correspondence electrifying duty ratio is set according to a first voltage and the heater electrifying control means performs electrifying control relative to the fixing heater using the set power correspondence electrifying duty ratio.

13. The image forming apparatus according to claim 12, further comprising:

means, including the fixing heater, for fixing a toner image to the sheet;

means for detecting a surface temperature of the fixing device; and means for detecting a voltage of a commercial power source supplying electricity to the fixing heater of the fixing device.

14. A method of controlling electrifying of a fixing heater of a fixing device in an electrophotographic image forming apparatus, the method comprising:

setting a ratio of an electrifying or non-electrifying time per a unit time relative to the fixing heater according to a first voltage as a power correspondence electrifying duty ratio and performing electrifying control relative to the fixing heater using the set power corresponding electrifying duty ratio, when electrifying the fixing heater immediately after a commercial power source of the apparatus has been turned on or immediately after the apparatus has returned to a standby state from a power saving mode;

detecting a voltage of a commercial power source, obtaining, according to a detected voltage of the commercial power source, a ratio of an electrifying or non-electrifying time per a unit time relative the fixing heater as a power correspondence electrifying duty ratio, and storing the power correspondence electrifying duty ratio;

detecting a surface temperature of the fixing device, and obtaining, according to a detected surface temperature, a ratio of an electrifying or non-electrifying time per a unit time relative to the fixing heater as a temperature correspondence electrifying duty ratio; and comparing the temperature correspondence electrifying duty ratio and the stored power correspondence electrifying duty ratio, and when the temperature correspondence electrifying duty ratio is equal to or larger than the stored power correspondence electrifying duty ratio, restricting the temperature correspondence electrifying duty ratio with the stored power correspondence electrifying duty ratio to obtain a restricted electrifying duty ratio, and performing electrifying control relative to the fixing heater using the restricted electrifying duty ratio.

15. The method according to claim 14, wherein a value of the first voltage is set such that the power correspondence electrifying duty ratio set according to the first voltage is equal to or below a value.

16. The method according to claim 15, wherein the first voltage is an upper limit voltage of the apparatus.

17. The method according to claim 14, wherein the voltage detecting and a power correspondence electrifying duty ratio storing step is performed while electrifying of the fixing heater using the power correspondence electrifying duty ratio set according to the first voltage is being performed.

18. The method according to claim 17, wherein the voltage detecting and a power correspondence electrifying duty ratio storing step is started a time after the electrifying of the fixing heater using the power correspondence electrifying duty ratio set according to the first voltage has been started.

19. The method according to claim 18, wherein the time is a time necessary for the fixing heater to be in a state that a resistance value thereof is stabilized after the electrifying of the fixing heater using the power correspondence electrifying duty ratio set according to the voltage has been started.

* * * * *